US008246307B2

(12) United States Patent
Cheong et al.

(10) Patent No.: US 8,246,307 B2
(45) Date of Patent: Aug. 21, 2012

(54) BLADE FOR A ROTOR

(75) Inventors: Brian C. Y. Cheong, Bristol (GB); Stephen C. Diamond, Tuscany (IT)

(73) Assignee: Rolls-Royce PLC, London (GB)

( * ) Notice: Subject to any disclaimer, the term of this patent is extended or adjusted under 35 U.S.C. 154(b) by 582 days.

(21) Appl. No.: 12/458,148

(22) Filed: Jul. 1, 2009

(65) Prior Publication Data

US 2010/0098554 A1 Apr. 22, 2010

(30) Foreign Application Priority Data

Jul. 24, 2008 (GB) ..... 0813556.8
Aug. 27, 2008 (GB) ..... 0815542.6

(51) Int. Cl.
*F01D 5/08* (2006.01)
*F01D 5/18* (2006.01)

(52) U.S. Cl. ..... 416/97 R; 416/96 R; 416/96 A; 416/228; 416/235; 415/115; 415/173.4

(58) Field of Classification Search ..... 415/115, 415/116, 173.1, 173.4; 416/92, 96 R, 96 A, 416/97 R, 228, 235
See application file for complete search history.

(56) References Cited

U.S. PATENT DOCUMENTS

| | | | | |
|---|---|---|---|---|
| 6,164,914 | A | 12/2000 | Correia et al. | |
| 6,494,678 | B1 * | 12/2002 | Bunker | 416/97 R |
| 6,790,005 | B2 * | 9/2004 | Lee et al. | 416/97 R |
| 7,972,115 | B2 * | 7/2011 | Potier | 416/228 |
| 2007/0059182 | A1 | 3/2007 | Stegemiller et al. | |

FOREIGN PATENT DOCUMENTS

| | | | |
|---|---|---|---|
| EP | 0 801 209 | A2 | 10/1997 |
| EP | 1 895 101 | A2 | 3/2008 |
| GB | 2 413 160 | A | 10/2005 |

* cited by examiner

*Primary Examiner* — Igor Kershteyn
(74) *Attorney, Agent, or Firm* — Oliff & Berridge, PLC

(57) ABSTRACT

A blade for a rotor, such as a turbine rotor of a gas turbine engine, has a squealer tip comprising a peripheral wall which defines a cavity. A first region of the peripheral wall extends radially, with its outer surface forming a continuation of the adjacent aerofoil surface of the blade. A second region extends obliquely with respect to the radial direction and the adjacent part of the aerofoil surface. The second region defines a winglet, and serves to increase the width of the chamber towards the trailing edge of the blade.

21 Claims, 3 Drawing Sheets

BLADE FOR A ROTOR

This invention relates to a blade for a rotor, and is particularly, although not exclusively, concerned with a blade such as a turbine blade for a rotor to be used in a gas turbine engine.

EP 0801209 discloses a turbine rotor blade which, at its radially outer end, has a cavity or passage defined by a peripheral wall which has an aperture at the trailing edge of the blade. The peripheral wall extends radially from lateral projections on opposite sides of the blade. The function of the cavity is to trap gas which leaks past the peripheral wall on the pressure side of the blade. The trapped gas forms a vortex within the cavity, and flows from the cavity through the aperture at the trailing edge. This configuration serves to avoid losses in efficiency caused by gas leakage over the turbine blade tips and also to avoid losses caused by flow disturbances set up by the leakage flow.

Such configurations at the tip of a rotor blade are sometimes referred to as "squealer tips". A cooling arrangement for a squealer tip is disclosed in U.S. Pat. No. 6,164,914. Air is bled from a cooling circuit within the blade to a plenum situated just beneath the squealer tip. Air flows into the plenum through impingement holes which direct jets of air at the internal surfaces of a tip cap forming the base of the cavity between the peripheral walls at the junction between the tip cap and the peripheral walls.

The squealer tip configuration of EP 0801209 comprises a relatively massive structure constituted by the peripheral wall itself and the lateral extensions of the blade which support it. This additional mass generates high mechanical stresses, particularly at the connection between the blade and the rotor hub. This imposes a limitation on the maximum rotational speed of the rotor. There are also difficulties associated with cooling of the peripheral wall and the lateral extensions, since they are situated away from the main aerofoil section of the blade in which a cooling circuit may be provided. Adequate cooling consequently requires an increased supply of cooling air, leading to reduced engine efficiency.

The cooling arrangement disclosed in U.S. Pat. No. 6,164,914 uses a common plenum for supplying cooling air for cooling both the pressure and suction sides of the blade. Air passing through the impingement holes is drawn from different parts of the cooling circuit within the main body of the blade, and consequently air flowing through different impingement holes has different temperatures. There are therefore difficulties in controlling the cooling effectiveness of the air delivered through the impingement holes, and it is difficult to localise cooling to specific hot spots, for example at the trailing edge region of the blade.

According to the present invention there is provided a blade for a rotor, the blade having an aerofoil surface comprising pressure and suction sides extending between a leading edge and a trailing edge of the aerofoil surface, and having a squealer tip comprising a peripheral wall surrounding a cavity which is open at a radial end of the blade and at the trailing edge of the blade, wherein the peripheral wall comprises at least one first region which extends radially and has an outer surface which is a continuation of the aerofoil surface, and at least one second region which is inclined outwardly of the cavity with respect to the radial direction, and has an outer surface which extends obliquely outwardly of the blade from the aerofoil surface along part of at least one of the pressure side and suction side.

In this specification, terms such as "radial", "axial", and "circumferential" refer to the axis of the rotor on which the blade is, or is intended to be, mounted. It will be appreciated that these terms are not used in a precise geometrical sense, since the aerofoil surface of the blade has a complex curvature, and the blade may not extend exactly radially of the rotor axis over its entire length.

The second region, or at least one of the second regions, may comprise a pressure side winglet extending along part of the pressure side of the aerofoil surface. In one embodiment, the pressure side winglet extends from a leading end positioned between the leading edge and the trailing edge of the aerofoil surface, to a trailing end situated at the opening of the cavity at the trailing edge of the aerofoil surface. Consequently, the pressure side winglet may terminate, at its trailing end, at the end of the peripheral wall on the pressure side of the aerofoil surface.

The leading end of the pressure side winglet may be situated approximately midway between the leading edge and the trailing edge of the aerofoil surface. In other words, the leading end of the pressure side winglet may be situated approximately 50% of the distance along the chordwise width of the blade. In another embodiment, the pressure side winglet may extend between its leading end and trailing end from a position approximately 20% along the chordwise width of the blade from the leading edge to a position approximately 70% along the chordwise width.

The second region, or at least one of the second regions, may comprise a suction side winglet extending along part of the suction side of the aerofoil surface. The suction side winglet may extend from a leading end situated approximately 60% along the chordwise width of the blade from the leading edge to the trailing edge of the blade. Alternatively the suction side winglet extends from a leading end positioned approximately in the range of about 40% to about 90% of the chordwise distance from the leading edge, to the trailing edge.

For both the pressure side winglet and the suction side winglet, there may be a transition region between the first region of the peripheral wall to the leading end of the winglet, in which transitional region the peripheral wall may have a radially inner portion extending radially, with an outer surface which is a continuation of the aerofoil surface, and a radially outer portion which is inclined outwardly of the cavity with respect to the radial direction and has an outer surface extending obliquely outwardly of the blade from the aerofoil surface.

The or each winglet and the first portion of the peripheral wall may terminate at their radially outer ends in end surfaces which lie in a common plane. The common plane may be arcuate, conforming to the profile of an inner surface of a casing part within which the rotor rotates.

The end surface of the or each winglet may vary in circumferential width along the length of the winglet and thus may increase in width from the leading end to an intermediate region of the winglet, and then decrease in width towards the trailing end of the winglet.

The peripheral wall may extend radially outwardly from a partition which defines the base of the cavity. The ratio of the width of the cavity to the depth of the cavity may be in the range 1 to 5 along the length of the cavity between the leading edge and the trailing edge of the aerofoil surface.

The blade may be provided with a cooling passage which has an extension projecting into the peripheral wall on one side of the cavity, the extension communicating through at least one duct with a chamber extending into the peripheral wall on the other side of the cavity, the duct, or at least one of the ducts, being configured to admit cooling fluid through the chamber in a manner to effect impingement cooling of an internal surface of the chamber.

The chamber may communicate with the exterior of the blade through film cooling holes, at least one of which may emerge into the cavity. If the peripheral wall comprises a pressure side winglet and a suction side winglet, the extension may project into the pressure side winglet, and the chamber may extend into the suction side winglet.

The present invention also provides a rotor including an array of blades, each as defined above. A further aspect of the present invention provides a gas turbine engine provided with such a rotor.

For a better understanding of the present invention, and to show more clearly how it may be carried into effect, reference will now be made, by way of example, to the accompanying drawings, in which.

Figure 1:
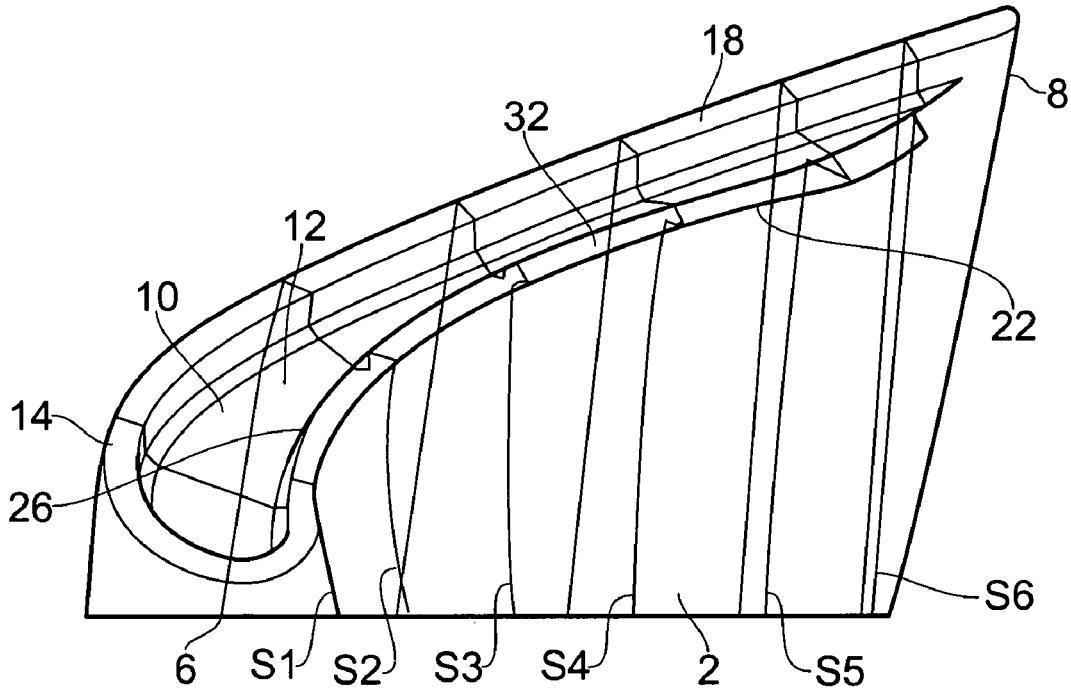
FIG. 1 shows the radially outer tip region of a turbine blade forming part of a turbine rotor of a gas turbine engine according to the present invention.
Figure 4:
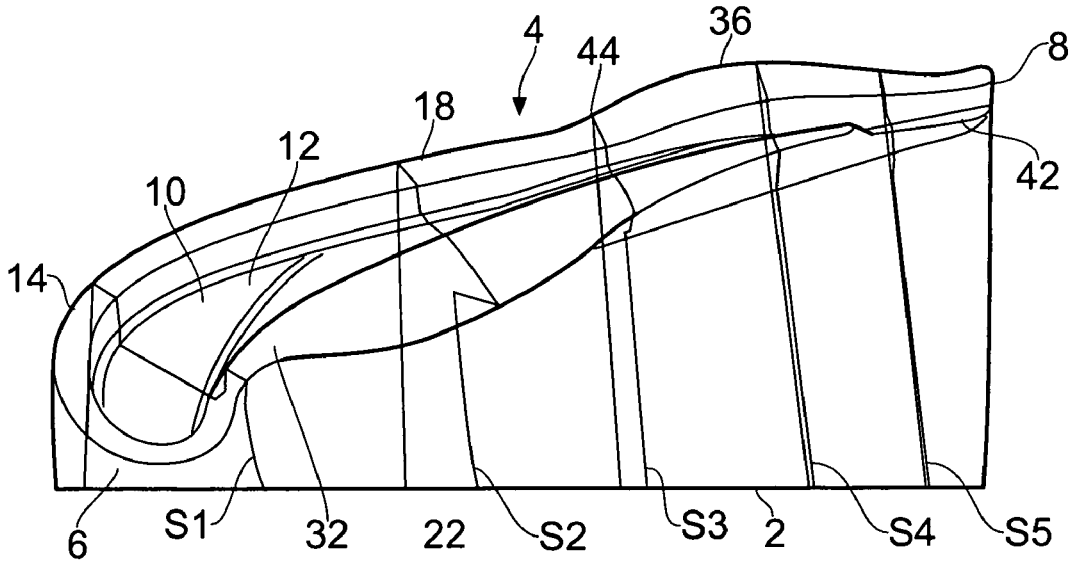
Figure 5:
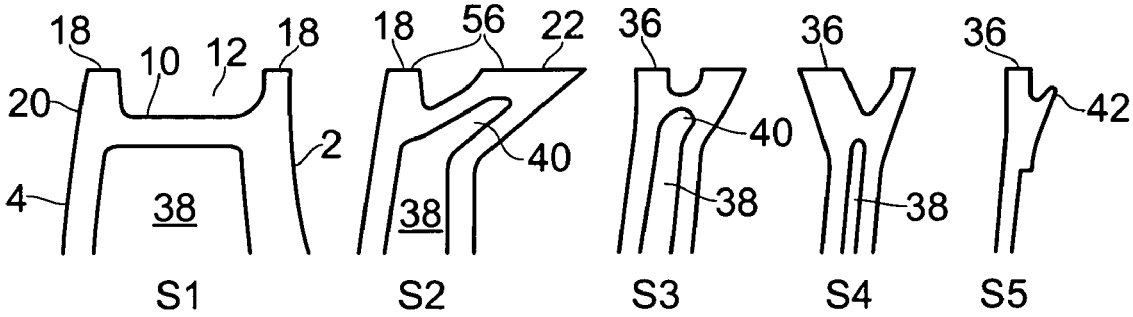
Figure 6:
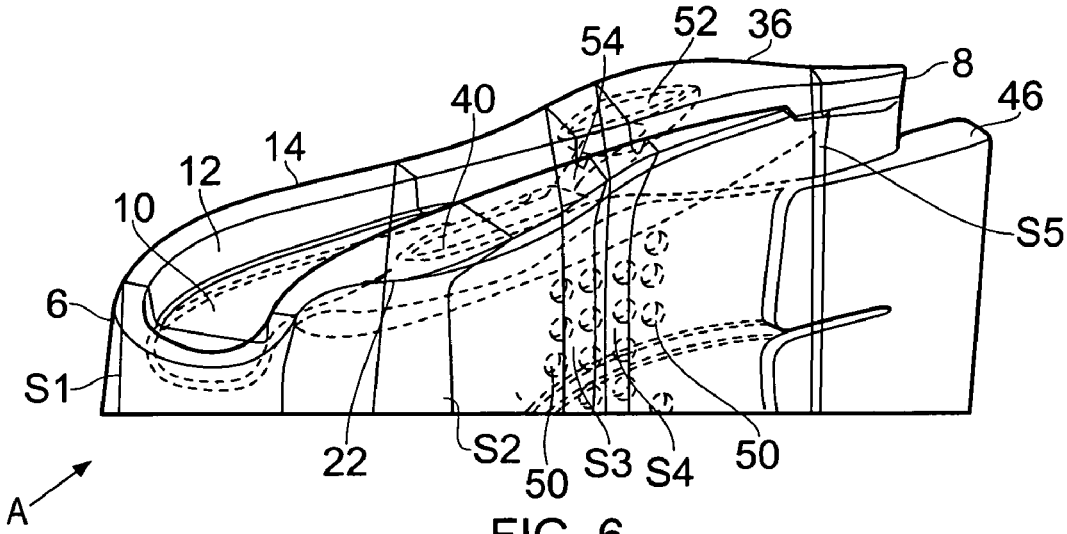
Figure 7:
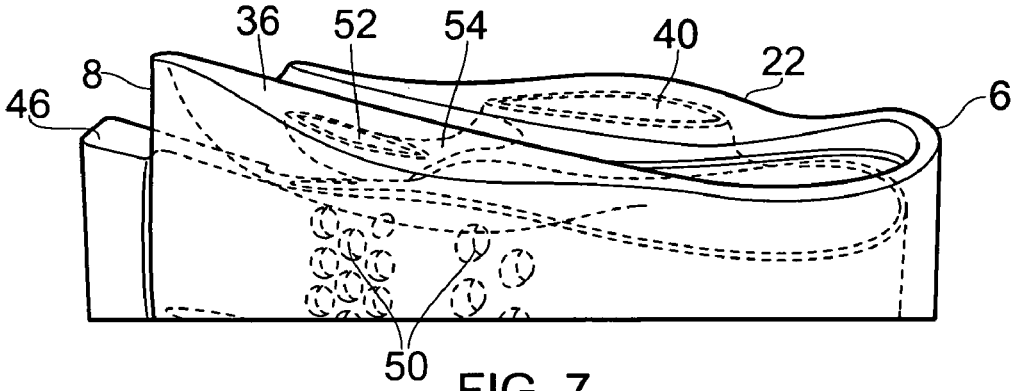
Figure 8:
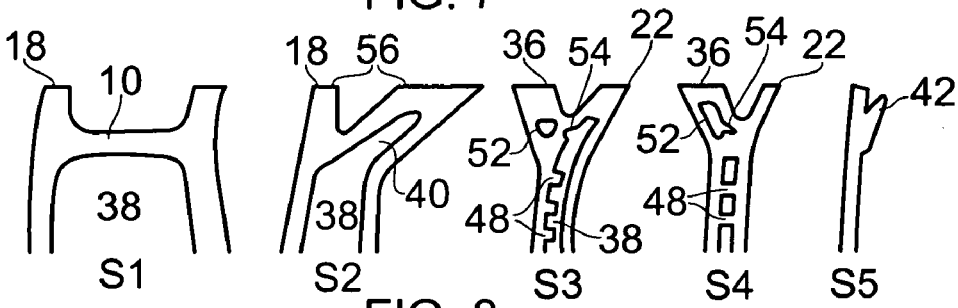
Figure 9:
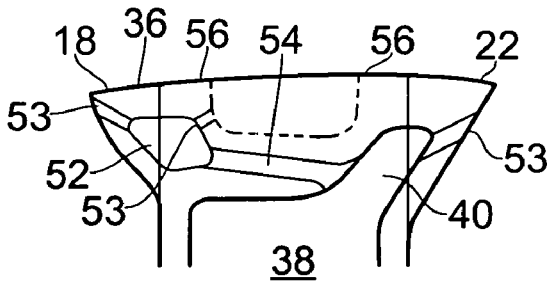

FIG. 4 corresponds to FIG. 1 but shows an alternative configuration of tip region;

FIG. 5 shows sections S1-S5 represented in FIG. 4;

FIG. 6 corresponds to FIG. 4 but shows a third configuration of the tip region;

FIG. 7 is an alternative view of the tip region of FIG. 6;

FIG. 8 shows the cross-sections S1-S5 represented in FIGS. 6 and 7; and FIG. 9 shows a sectional view on arrow "A" in FIG. 6.

Figure 2:
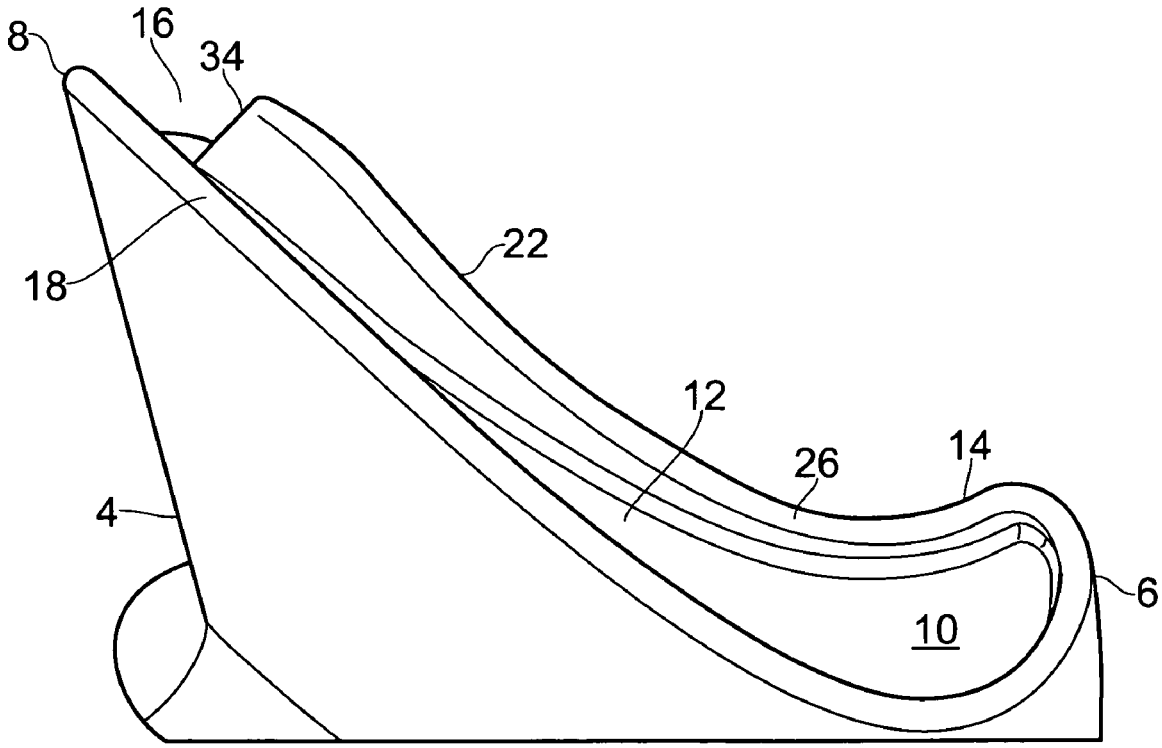
FIG. 2 is an alternative view of the tip region shown in FIG. 1.

The blade shown in FIGS. 1 and 2 has an aerofoil surface made up of a pressure side 2 and a suction side 4, both extending from a leading edge 6 to a trailing edge 8.

The radial tip of the blade is formed as a squealer tip, comprising a partition 10 and a peripheral wall 14, which define a cavity 12. The cavity 12 is open at the radial tip of the blade, and, through an opening 16 at the trailing edge 8 of the blade.

Figure 3:
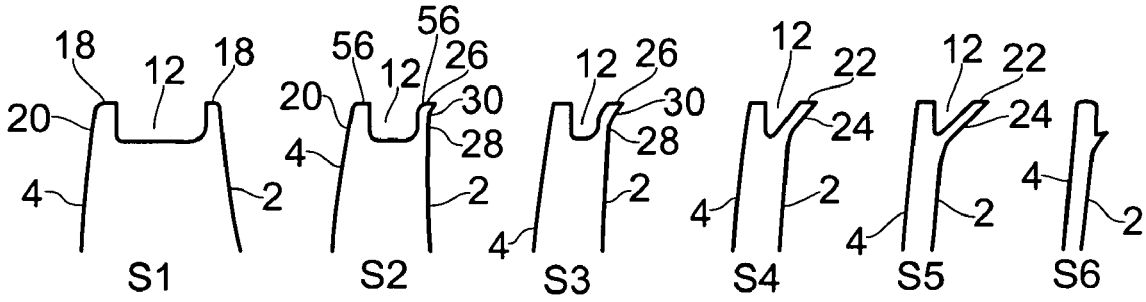
FIG. 3 shows sections S1-S6 shown in FIG. 1.

It will be appreciated from FIGS. 1 to 3 that the peripheral wall 14 comprises a first region 18 which extends from the trailing edge 8 over the suction surface 4, round the leading edge 6 and part of the way along the pressure surface 2. This first region 18 extends generally radially, and its outer surface 20 is a smooth continuation of the profile of the aerofoil surface, both on the pressure side 2 and the suction side 4.

The peripheral wall 14 also has a second region 22 which is in the form of a winglet extending generally over the rear (ie nearer the trailing edge 8) portion of the pressure side of the blade tip. This second region 22, as is clear from sections S4 and S5 in FIG. 3, is inclined outwardly of the cavity 12 with respect to the radial direction. The outer surface of the winglet is thus also inclined to the pressure side of the aerofoil surface. Between the first region 18 and the second region or winglet 22, there is a transition region 26, shown in sections S2 and S3 in FIG. 3. In the transition region 26, the peripheral wall 14 has two portions, namely a first portion 28 which extends radially, like the first region 18, and a second portion 30, which is inclined, like the second region or winglet 22. Thus, as the transition region 26 extends away from the leading edge 6, the second portion 30 becomes larger, to merge with the second region 22, while the first portion 28 becomes smaller.

In the specific embodiment shown in FIGS. 1 to 3, the winglet 22 extends from a leading end 32, which is situated approximately midway between the leading and trailing edges 6, 8, ie 50% of the chordwise distance from the leading edge 6 to the trailing edge 8, to the trailing edge 8, or, more precisely, to the region of the trailing edge 8 defined by the end 34 of the peripheral wall 14 on the pressure side 2. The transition region 26 extends, in the embodiment shown in FIGS. 1 to 3, from a position approximately 25% of the chordwise distance from the leading edge 6 to the trailing edge 8, to the leading end 32 of the winglet 22.

Because the winglet 22 is inclined from the radial direction, it has the effect of widening the cavity 12 as it approaches the trailing edge 8. The result is that, in use of the blade, gas leaking over the peripheral wall 14 on the pressure side 2 will, over the full extent of the pressure side 2, encounter a region of the cavity 12 having a width which is sufficiently large to enable the overflowing air to reattach within the cavity 12 and so remain captured until it is discharged through the opening 16 at the trailing edge 8.

Although the width of the cavity 12 may vary in the chordwise direction, the ratio of the width of the cavity 12 to its depth may typically be maintained within the range 1 to 5, and where possible 1.5 to 5. By achieving the width increase in the trailing edge region of the blade by forming the peripheral wall 14 as the winglet 22, enhanced sealing against leakage over the blade tip can be achieved without significant weight penalty. While most of the gas entering the cavity 12 will be discharged through the opening 16 at the trailing edge 8, some may leak over the peripheral wall 14 on the suction side 4. This leakage will interact and roll up with a secondary vortex generated in the main gas flow stream flowing over the suction side 4. However, owing to the increased width of the cavity 12, this leakage, and the loss induced by the over-tip leakage vortex, is diminished.

Additionally, the winglet 22 is situated at a region of the blade tip which is exposed to the hottest gas flowing from upstream nozzle guide vanes. The position of the winglet 22 at the rearward end of the pressure side provides easier access to cooling air from internal passages within the blade, leading to enhanced cooling.

FIGS. 4 and 5 shown an alternative embodiment. For convenience, features in common with the embodiment shown in FIGS. 1 to 3 are indicated by the same reference numbers.

In the embodiment of FIGS. 4 and 5, the winglet 22, comprising a second region of the peripheral wall 14, is displaced further towards the leading edge 6 than the winglet 22 in the embodiment of FIGS. 1 to 3. Furthermore, an additional second region of the peripheral wall 14 is provided on the suction side 4, in the form of a winglet 36.

As shown in FIG. 5, the interior of the blade is provided with a cooling circuit which includes a passage 38 which extends chordwise of the blade from a position close to the leading edge 6 (S1) to a position close to the trailing edge 8 (S5). It will be appreciated from the section 2 that the cooling passage 38 includes an extension 40 which projects into the pressure side winglet 22, so enhancing cooling in this region. Although not shown in FIG. 5, it would be possible also for the cooling passage 38 to have an extension projecting into the suction side winglet 36, for example at section 4. This is possible because the additional thickness obtained from the profile of the winglet 36 provides sufficient metal to accommodate the required internal cooling circuit.

In the embodiment of FIG. 4, the pressure side winglet 22 extends from a leading end 32 which is at a position approximately 20% along the chordwise length of the blade from the leading edge 6. The trailing edge of the winglet 22 is situated approximately 70% of the distance along the chordwise direction from the leading edge 6, at a point where the peripheral wall 14 drops in height to form a ledge 42 over which gas emerging from the cavity 12 can flow.

The suction side winglet 36 is situated towards the trailing edge 8, and, in the embodiment shown, extends from a leading end 44 position approximately 65% along the chordwise distance of the blade, to a trailing end situated at the trailing edge 8 of the blade. The pressure side winglet 22 is configured and positioned to create a greater pressure drop in the oncoming tip swirl flow which is predominant in the middle region between the leading and trailing edges 6, 8.

Both the pressure side winglet 22 and the suction side winglet 36, by virtue of their inclined orientation relative to the radial direction, serve to increase the width of the cavity 12 so as to cause leakage flow to trip over the peripheral wall 14 on the pressure side 2, and to reattach within the cavity 12, as mentioned above with regard to FIGS. 1 and 3. In the embodiment of FIGS. 4 and 5, the ratio of the width to the depth of the cavity 12 is typically in the range 1 to 5.

The embodiment shown in FIGS. 6 to 9 is similar to that of FIGS. 4 and 5 in terms of the external contours of the blade. However, FIGS. 6 and 7 also represent the internal cooling circuit of the blade by way of a core 46 which is used to form it. FIG. 9 is a sectional end on view in the direction of arrow "A" in FIG. 6.

The cooling circuit comprises a passage 38, as shown in FIG. 5, with an extension 40 into the pressure side winglet 22. Towards the trailing edge 8 of the blade, columns 48, formed by holes 50 in the core, extend completely or partially across the passage 38 to enhance heat transfer. The columns 48 (sometimes referred to as "pedestals") may also act as localised flow restrictors which, in operation, meter air passing between them to control the flow of air exiting from the trailing edge.

In order to provide cooling to the suction side winglet 36, a chamber 52 is branched from the extension 40 at a position approximately 50% of the chordwise width from the leading edge 6. The chamber 52 extends towards the trailing edge of the blade, as indicated in sections S3 and S4.

The connection between the chamber 52 and the extension 50 is provided by one or more channels 54 (only one shown in FIGS. 6 and 7). The channel 54 is configured as an impingement channel, so that cooling air flowing into the chamber 52 from the extension 40 is directed as an impingement jet against an internal surface of the chamber 52 to enhance heat transfer. Cooling passages 53 are provided in the wall of the chamber 52, and are configured to exhaust cooling air from the chamber 52 such that, in use, the chamber 52 has a lower static pressure than the passage 38. Hence air will be drawn from the chamber 38 along the channel 54 to impinge on the internal surface of chamber 52. Thus heat transfer is increased in this region beyond that which could be achieved by convection cooling alone in this arrangement.

Additional film cooling holes may be provided to convey cooling air from the cooling circuit 38 (including the extension 40 and the chamber 52) to the exterior surface of the blade in order to provide film cooling. The film cooling passages may emerge on the aerofoil surface of the blade, but at least some of them may emerge from the base 10 or the peripheral wall 14 to provide film cooling of these components within the cavity 12. Similar film cooling passages may be provided in the embodiments shown in FIGS. 1 to 5.

The cooling arrangement shown in FIGS. 6 to 9 enables relatively cool cooling air to be supplied to the peripheral wall 14 on both the pressure and suction sides 2, 4. Thus, if the cooling circuit within the blade is configured as a multi-pass arrangement in which cooling air flows in series through radial passages interconnected at bends at the radially inner and outer end regions of the blade, the air for the passage 38, and the extension 40 can be drawn from the first or second of the radial passages within the blade, where the air is relatively cool, compared with the air reaching the trailing edge region of the blade after several passes along the blade in the radial direction. Consequently, the air reaching the chamber 52 is also relatively cool, and this configuration is therefore capable of providing effective cooling for regions of the blade tip that are subjected to hot gas flows. Furthermore, the use of impingement cooling within the chamber 52 enables this region of the peripheral wall 14 to be cooled by internal air flow, rather than by film cooling. This reduces the requirement for film cooling holes, so reducing the loss of air for cooling purposes, with a consequent increase in engine efficiency.

The chamber 52, the channel or channels 54 and the extension 40 may be formed by use of a single core 46. This eliminates mechanical stresses resulting from drilling operations otherwise required to form these features, and also avoids the need to weld off holes formed as part of the drilling operation.

It will be appreciated from the sectional views of FIGS. 3, 5 and 8 that the peripheral wall 14, including the winglets 22 and 36, terminate at faces 56 which all lie in a common plane. Although represented as generally flat planes, the faces 56 are, in fact, profiled to conform to the curvature of the internal surface of an engine casing along which the blade tip moves during rotation of the rotor.

It will be appreciated from, for example, sections S2 to S4 in FIGS. 5 and 8 that the end surfaces 56 of the pressure and suction side winglets 22, 36 are relatively wide. This width serves to reduce leakage across the blade tip, and also is associated with increased thickness of the peripheral wall 14 to accommodate cooling features as described above.

In FIGS. 6 to 9, the cooling passage extension 40 is shown provided in the pressure side winglet 22 and the chamber 52 in the suction side winglet 36. In a further embodiment, the cooling passage extension 40 is provided in the suction side winglet 36 and the chamber 52 in the pressure side winglet 22.

The invention claimed is:

1. A blade for a rotor, the blade having an aerofoil surface comprising pressure and suction sides extending between a leading edge and a trailing edge of the aerofoil surface, and having a squealer tip comprising a continuous peripheral wall surrounding a cavity which is open at a radial end of the blade and at the trailing edge of the blade, wherein the peripheral wall comprises at least one first region which extends radially and has an outer surface which is a continuation of the aerofoil surface, and at least one second region which is inclined outwardly of the cavity with respect to the radial direction and has an outer surface which extends obliquely outwardly of the blade from the aerofoil surface along part of at least one of the pressure side and the suction side.

2. A blade as claimed in claim 1, wherein the second region or at least one of the second regions, comprises a pressure side winglet extending along part of the pressure side.

3. A blade as claimed in claim 2, wherein the pressure side winglet extends from a leading end positioned between the leading edge and the trailing edge, to a trailing end situated at the opening of the cavity at the trailing edge.

4. A blade as claimed in claim 3, wherein the leading end is positioned approximately midway between the leading edge and the trailing edge.

5. A blade as claimed in claim 3, wherein the leading end of the winglet is positioned approximately 20% of a chordwise distance from the leading edge, and the trailing end is disposed approximately 70% of the chordwise distance from the leading edge.

6. A blade as claimed in claim 1, wherein the second region or at least one of the second regions, is a suction side winglet extending along part of the suction side.

7. A blade as claimed in claim 6, wherein the suction side winglet extends from a leading end positioned approximately 60% of a chordwise distance from the leading edge, to the trailing edge.

8. A blade as claimed in claim 6, wherein the suction side winglet extends from a leading end positioned approximately in the range of about 40% to about 90% of a chordwise distance from the leading edge, to the trailing edge.

9. A blade as claimed in claim 1, wherein a transition region extends between the first region and a leading end of the second region in which transition the peripheral wall has a radially inner portion extending radially and having an outer surface which is a continuation of the aerofoil surface, and a radially outer portion which is inclined outwardly of the cavity with respect to the radial direction, and has an outer surface which extends obliquely outwardly of the blade from the aerofoil surface.

10. A blade as claimed in claim 2, wherein the or each winglet and the first region of the peripheral wall terminate at their radially outer ends in end surfaces which lie in a common plane.

11. A blade as claimed in claim 10, wherein the end surface of the or each winglet varies in circumferential width along a length of the winglet.

12. A blade as claimed in claim 1, wherein the peripheral wall extends from a partition defining a base of the cavity.

13. A blade as claimed in claim 12, wherein a ratio of a width to a depth of the cavity is not less than 1 and not more than 5.

14. A blade as claimed in claim 1, wherein the blade is provided with a cooling passage which has an extension projecting into the peripheral wall on one side of the cavity, the extension communicating through at least one duct with a chamber extending into the peripheral wall on the other side of the cavity, the duct, or at least one of the ducts, being configured to admit cooling fluid to the chamber in a manner to effect impingement cooling of an internal surface of the chamber.

15. A blade as claimed in claim 14, wherein the chamber communicates with an exterior of the blade through film cooling holes.

16. A blade as claimed in claim 15, wherein at least one of the film cooling holes emerges into the cavity.

17. A blade as claimed in claim 14, wherein the extension projects into a pressure side winglet and the chamber extends into a suction side winglet.

18. A rotor provided with a blade in accordance with claim 1.

19. A gas turbine engine provided with a rotor in accordance with claim 18.

20. A blade as claimed in claim 1, wherein the peripheral wall continuously extends from the trailing edge of the pressure surface of the blade to the trailing edge of the suction surface of the blade.

21. A blade as claimed in claim 1, wherein the peripheral wall continuously extends from the pressure surface of the blade to the suction surface of the blade across the leading edge of the blade.

* * * * *